US007104833B2

(12) United States Patent
Oesterhaus

(10) Patent No.: US 7,104,833 B2
(45) Date of Patent: Sep. 12, 2006

(54) ELECTRICAL CONNECTOR WITH RELEASE MEANS

(75) Inventor: Jens Oesterhaus, Detmold (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/288,626

(22) Filed: Nov. 29, 2005

(65) Prior Publication Data

US 2006/0128206 A1 Jun. 15, 2006

(30) Foreign Application Priority Data

Dec. 10, 2004 (DE) ..... 20 2004 019 109 U

(51) Int. Cl.
*H01R 11/20* (2006.01)
*H01R 4/26* (2006.01)

(52) U.S. Cl. ..... 439/441

(58) Field of Classification Search ..... 439/438–441
See application file for complete search history.

(56) References Cited

U.S. PATENT DOCUMENTS 5,685,735 A * 11/1997 Hohorst ..... 439/441

FOREIGN PATENT DOCUMENTS

DE 295 00 614.5 4/1995

* cited by examiner

*Primary Examiner*—Javaid H. Nasri
(74) *Attorney, Agent, or Firm*—Lawrence E. Laubscher, Sr.; Lawrence E. Laubscher, Jr.

(57) ABSTRACT

An electrical connector includes a housing having a chamber in which are mounted a bus bar, and a leaf spring that normally biases the end of a conductor that is inserted into the chamber into electrical engagement with the bus bar. A release member is connected with the housing for movement from a retracted position toward an extended release position, thereby to release the spring from the conductor so that the conductor may be removed from the housing. For ease of operation, the release member has a pair of angularly arranged surfaces that contain operating openings for selectively receiving the tip of an operating tool arranged at various angular positions relative to the housing.

13 Claims, 5 Drawing Sheets

ELECTRICAL CONNECTOR WITH RELEASE MEANS

BACKGROUND OF THE INVENTION

1. Field of the Invention

An electrical connector includes a housing having a chamber in which are mounted a bus bar, and a leaf spring that normally biases the end of a conductor that is inserted into the chamber into electrical engagement with the bus bar, characterized by the provision of a release member connected with the housing for movement from a retracted position toward an extended release position, thereby to release the spring from the conductor so that the conductor might be removed from the housing. For ease of operation, the release member has a pair of angularly arranged surfaces that contain operating openings for selectively receiving the tip of an operating tool arranged at various angular positions relative to the housing.

2. Brief Description of the Prior Art

As illustrated by the German Patent No. 295 00 614.5, it has been proposed in the prior art to provide an electrical connector arrangement in which a release member is operable relative to the connector housing to release the biasing leg of a leaf spring from locking engagement with a conductor, thereby to permit disengagement of the conductor from a bus bar contained within the housing, and removal of the conductor from the housing.

For the purpose of connecting fine-strand conductors to the bus bar, and/or for the disconnection and removal of the conductors from the housing, the assembly is provided with a disconnect member that is actuated either manually, or by means of an actuating tool, such as a screwdriver. The disconnect member acts upon the biasing leg of a leaf spring or the like to displace the same toward an unlocked position relative to a conductor that is introduced into the connector housing chamber. The present invention was developed to provide an improved release mechanism that permits the connection and disconnection of fine-strand conductors under tight space, poor accessibility, and difficult tool orientation situations.

BRIEF SUMMARY OF THE INVENTION

Accordingly, a primary object of the present invention is to provide a connector arrangement including a disconnect or release member that is operable by a release tool arranged at different orientations relative to the connector housing to effect release of the biasing spring from the conductor, thereby to permit removal of the conductor from the housing chamber.

According to a more specific object of the invention, the release member is pivotally connected with the connector housing for movement from a retracted position toward a release position in which the biasing leg of a leaf spring is released from the conductor, thereby to permit the removal of the conductor from the connector housing. The release member has a pair of angularly arranged support surfaces that contain operating recesses that selectively receive the tip of an operating tool, such as a screwdriver. Owing to the angular relationship between the support surfaces on the release member, the tool may be operated at different angles and in tight quarters relative to the connector housing to effect the desired release operation. The pivotal connection of the release member relative to the housing permits a greater versatility and positioning of the operating tool than does a linearly operable release member.

A further object of the invention is to provide on separate surfaces of the release member at least two operating slits that each have a V-shaped cross-sectional configuration, thereby to receive the tip of a screwdriver arranged at various positions relative to the connector housing.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
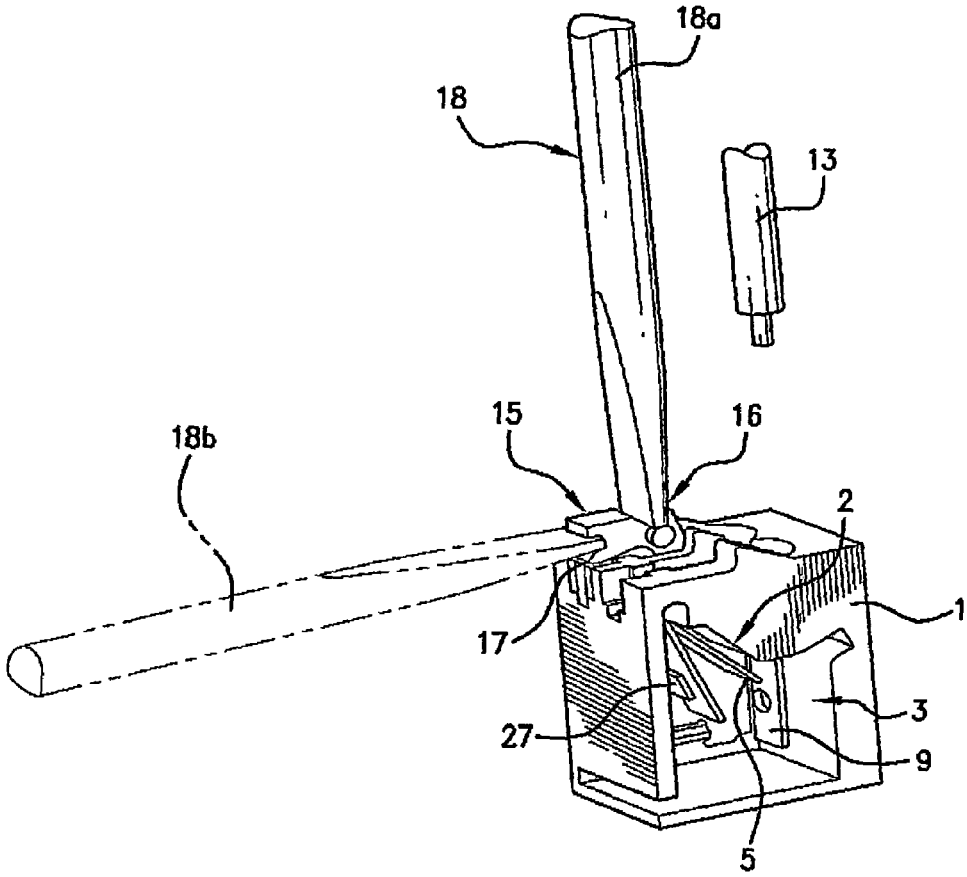
FIG. 1 is a front perspective view of the electrical connector of the present invention illustrating the manner of operation of the of the conductor release means.

Referring first more particularly to FIG. 1, the electrical connector assembly of the present invention comprises a terminal block housing 1 that is formed of an electrical insulating material and that contains a chamber 3. Mounted within the chamber is a stationary bus bar 9, together with a leaf spring 5 that serves to bias an electrical conductor 13 toward electrical engagement with the bus bar 9. In order to release the spring 5 from biasing engagement with the conductor 13, a release member 15 is provided that is pivotally connected with the housing 1, as will be described in greater detail below. According to a characterizing feature of the invention, the release member 15 includes a pair of angularly arranged surfaces 15*a* and 15*b* that contain operating recesses 16 and 17, respectively. These operating recesses are adapted to selectively receive an operating tool 18, such as a screw driver, having a pointed tip portion that is adapted to extend within either of the operating recesses 16 or 17 depending on the angular orientation of the operating tool 18.

Figure 2:
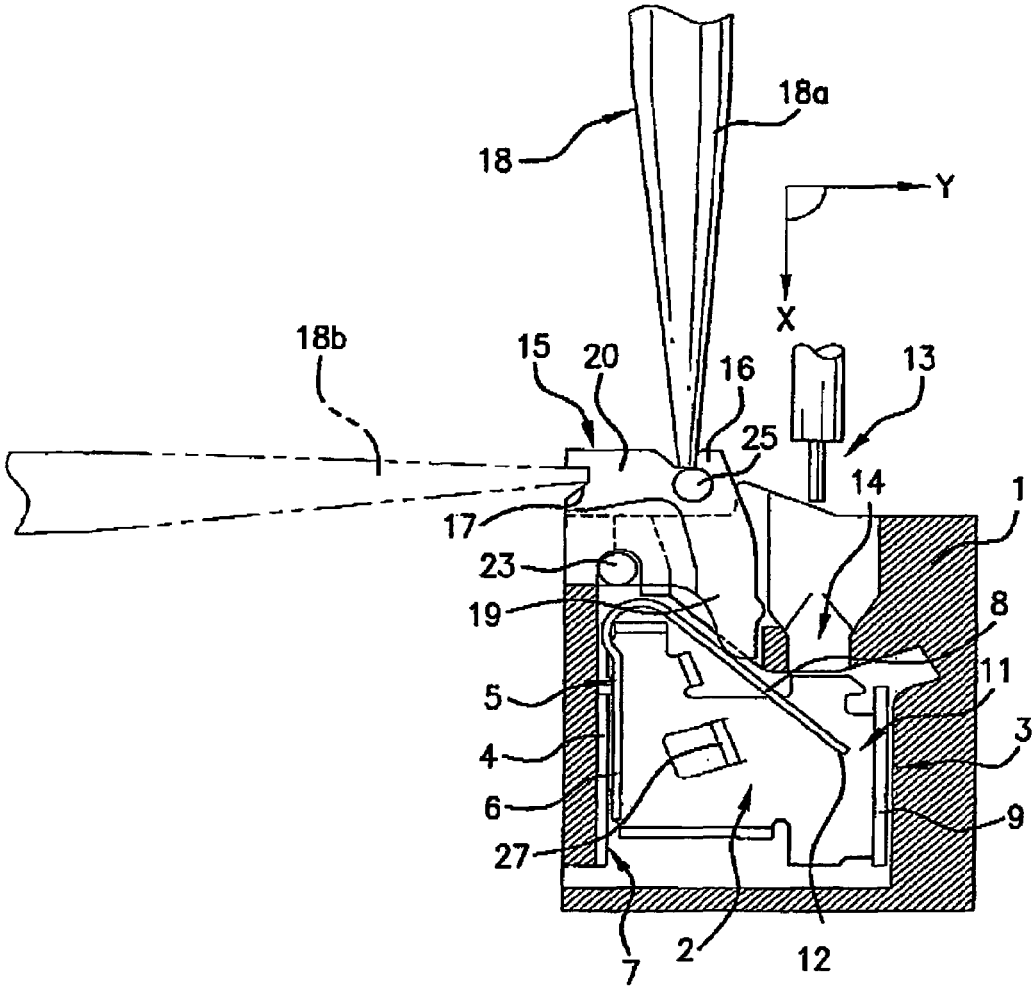
FIG. 2 is a side elevation view of the electrical connector of FIG. 1 with the release member in its retracted position.

Referring now to FIG. 2, the housing chamber 3 receives a metal cage element 2 having at one end the orthogonally bent bus bar portion 9, and at the other end a bent parallel portion 6 that defines the stationary first leg of a leaf spring 5. The leaf spring 5 has a generally inverted V-shaped configuration, and includes a second biasing leg 8 that extends toward the bus bar 3 below a conductor opening 14 contained in the housing and above the clamping zone 11 adjacent the bus bar 9. As is known in the art, a conductor 13 is introduced downwardly into the chamber 3 via the conductor opening 14, whereupon the spring leg 8 biases the bare end of the insulated conductor 13 into electrical contact with the bus bar 9.

Figure 4A:
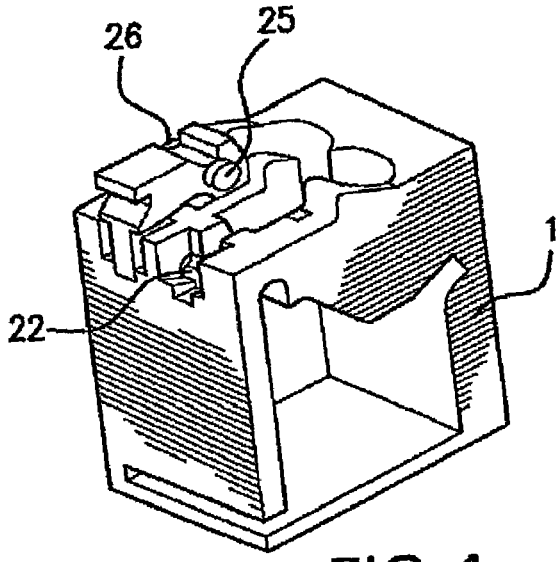
FIGS. 4*a* and 4*b* are detailed perspective and exploded views illustrating the release member in it assembled and disassembled condition relative to the housing, respectively.
Figure 4B:
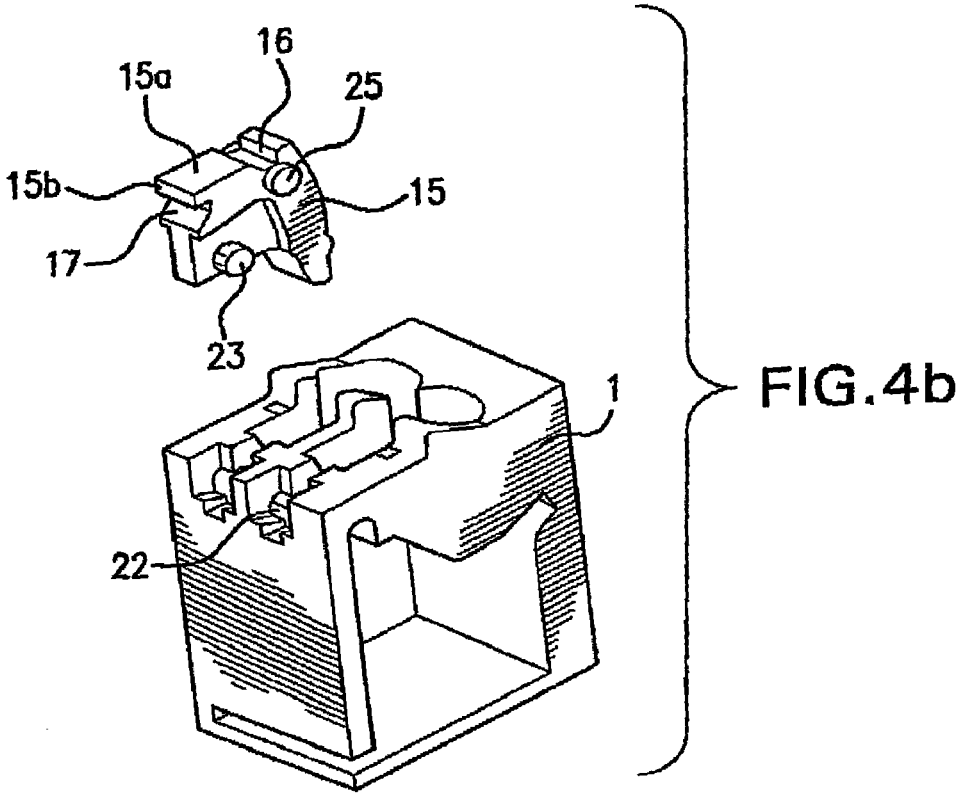
Figure 5A:
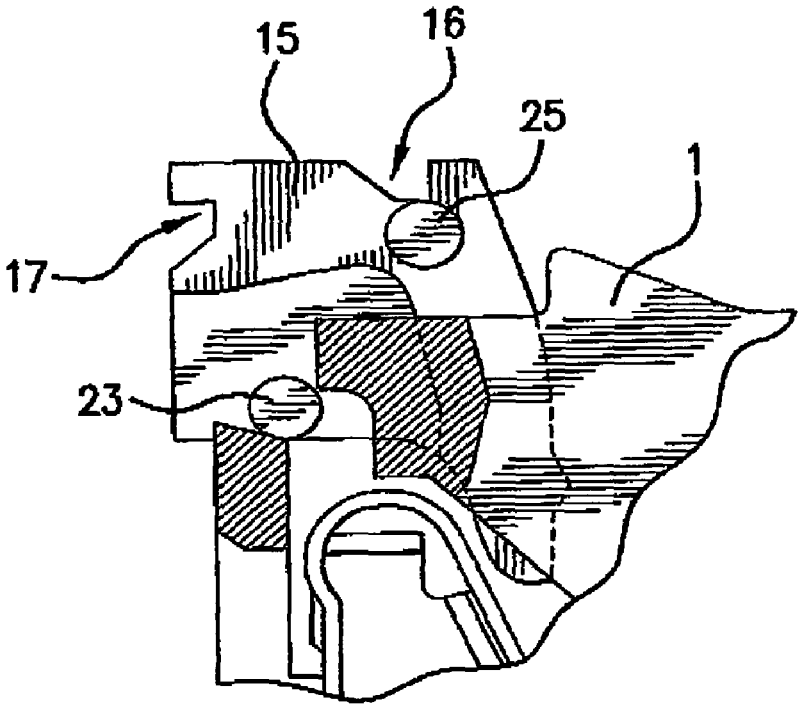
FIGS. 5*a* and 5*b* are detained elevation views illustrating the snap-fit assembly steps for connecting the release member with the housing.
Figure 5B:
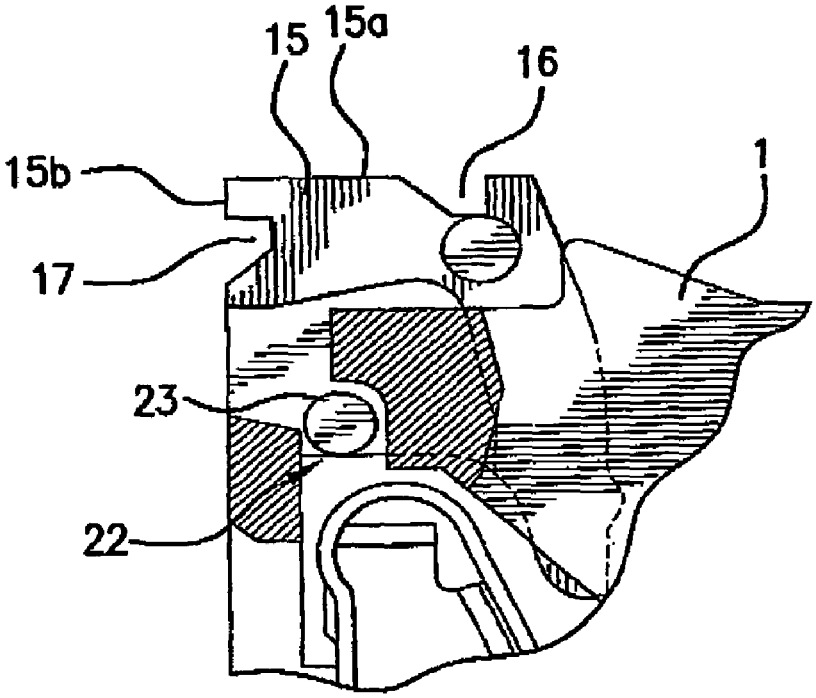

In accordance with a characterizing feature of the present invention, a release member 15 is pivotally connected with the housing 1 and extends within a release opening contained therein. As shown in FIG. 4*b*, the release member 15 has a generally L-shaped configuration, and includes an intermediate portion carrying a pivot shaft 23 having end portions that are journaled within corresponding journals 22 contained in the connector housing 1. Preferably the ends of the pivot pin 23 are connected in the bearing journals 22 by a snap-fit connection, as shown in FIGS. 5*a* and 5*b*.

As shown in FIG. 4*b*, the release member 15 includes a pair of orthogonally arranged surfaces 15*a* and 15*b* that contain the operating recesses 16 and 17, respectively. The recesses 16 and 17 have a V-shaped cross-sectional configuration, with the walls of the recesses being angularly arranged at an angle of from about 60° to about 120°. Thus, the operating recess 16 is adapted to receive the tip of a screwdriver 18 when in the position 18*a* of FIG. 1. Alternatively, the operating recess 17 is adapted to receive the tip of the screwdriver when the screwdriver is in the position 18*b* shown in FIG. 1.

In operation, assume that the insulated conductor 13 is relatively rigid, so that during downward insertion of the end of the conductor 13 within the chamber 3 via the conductor opening 14, the bare end of the conductor engages the adjacent spring leg 8 and deforms the same downwardly relative to the stationary leg 6. The sharp tip 12 of the second spring leg 8 automatically digs into and engages the outer surface of the conductor 13, thereby to retain the same and to bias the bare conductor toward electrical engagement with the stationary bus bar 9.

Figure 3:
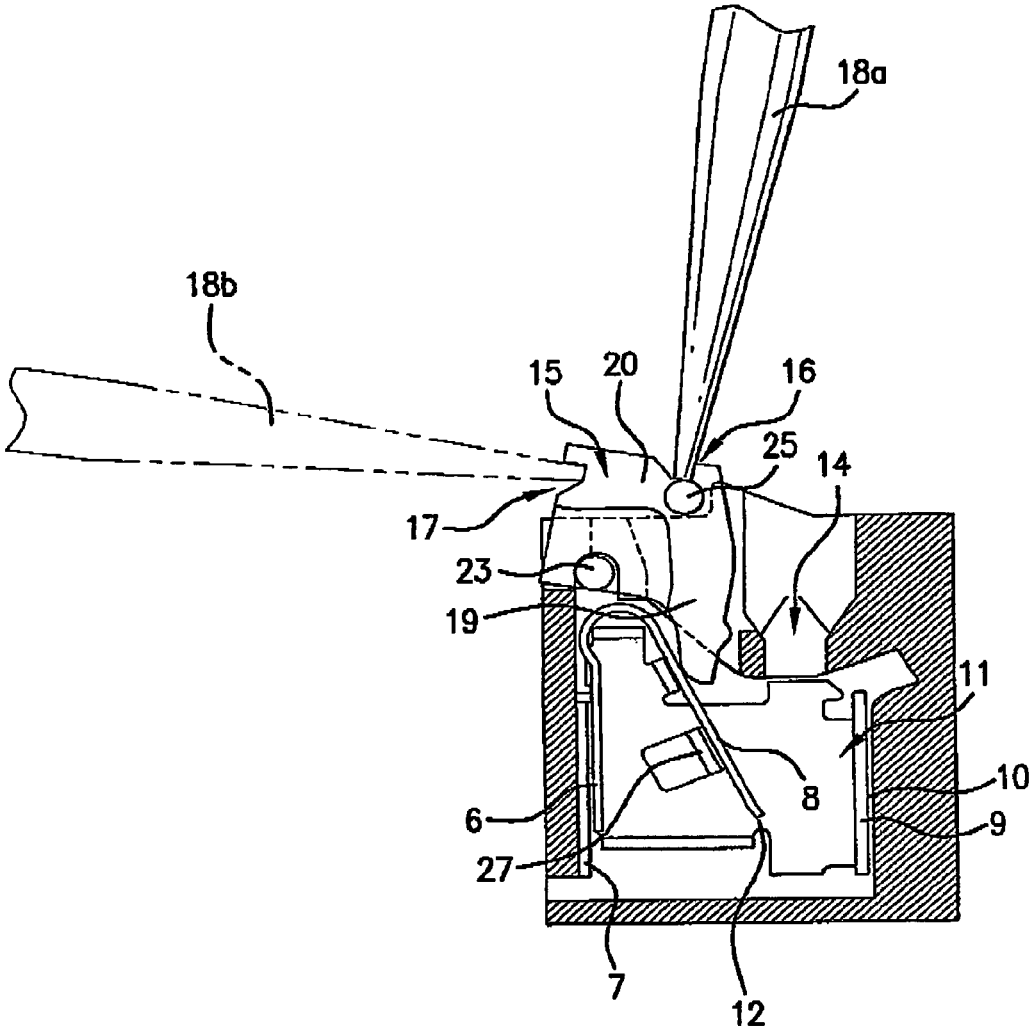
FIG. 3 illustrated the apparatus of FIG. 2 with the release member in its conductor release position.

In order to release the conductor 13, the release member 15 is pivoted by the tool 18*a* in the clockwise direction about the pivot axes 23 toward the released position of FIG. 3. Thus, the longer leg 19 of the L-shaped release member 15 engages the second leg portion 8 of the leaf spring 5, whereby the tip 12 of the second leg 8 is released from the conductor 13, thereby to permit removal of the conductor from the chamber 3 via the conductor opening 14.

Upon the removal of the conductor 13 from the housing 1, the spring leg 8 expands relative to the stationary spring leg 6, thereby to return the release member 15 to its original position shown in FIG. 2. In the event that the user wishes to operate the release member from a different direction (owing to tight quarters and/or limited space availability), the operator places the screwdriver in the position shown in phantom by the reference numeral 18*b*, whereupon the tip of the screwdriver engages the recess 17 to pivot the release member in the clockwise direction toward the release position shown in FIG. 3.

In accordance with another feature of the invention, stop means 25 are provided that limit the degree of pivotal movement of the release member in the clockwise direction. In this regard, the release member 15 is provided with a stop pin 25 that extends outwardly from each side of the release member 15 for engagement with corresponding bearing surfaces on the housing when the release member is pivoted to the fully released position of FIG. 3. Alternatively, the stop device may comprise a tab 27 that is punched out at right angles from the plate portion of the cage device 2, thereby to limit the extent of travel of the second leg of the leaf spring.

While the invention has been illustrated and described in connection with a terminal block 1 formed of electrical insulating material, it is apparent that the invention could apply equally as well in connection with an electrical appliance or other device having plug-in connections.

Referring again to FIG. 2, it will be seen that the force applied in the X-direction by the tool when in the position 18*a* is at right angles to the direction of force Y when the tool is in the alternate position illustrated by the reference numeral 18*b*. Of course, further operating recesses could be provided in various surfaces of the release member, depending on the tight quarters and accessibility to the release member.

The invention offers the advantage that a plurality of the connecting means 2 may be provided in a single housing 1, or a plurality of the housings containing the connecting means 2 could be provided in a side-by-side manner. Thus, only small space requirements are required when using the improved release member of the present invention.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector for connecting a conductor with a bus bar, comprising:

(a) a housing (1) formed of insulating material, said housing containing a chamber (3);

(b) a bus bar (9) mounted in said housing chamber, said housing containing a conductor opening (14) opposite said bus bar for the introduction of one end of the conductor into said chamber;

(c) spring means (5) mounted in said chamber for biasing the conductor into electrical contact with said bus bar; and (d) release means for releasing said spring means to permit removal of the conductor from said chamber, said release means including:

(1) a release member (15) mounted within a release opening contained in said housing for movement relative to said spring means from a retracted position toward an extended position, thereby to release said spring means from the conductor;

(2) said release member having a pair of angularly arranged operating surfaces containing recesses (16, 17) for receiving an operating tool (18) having different angular orientations relative to said housing, respectively.

2. A connector as defined in claim 1, wherein said release member is connected for pivotal movement relative to said housing, said release member being formed from an electrical insulating material.

3. A connector as defined in claim 2, wherein said recesses have a V-shaped cross section for receiving the tip of a screwdriver, respectively.

4. A connector as defined in claim 1, wherein said operating surfaces on said release member are orthogonally arranged.

5. A connector as defined in claim 4, wherein the side walls of said recesses are angularly arranged at an angle of from between 60° to 120°.

6. A connector as defined in claim 1, wherein said spring means includes a generally inverted V-shaped leaf spring (5) having a first leg portion (6) secured to one wall of said housing chamber, and a second leg portion (8) extending across said chamber beneath said conductor opening, said spring leg portions being normally biased apart.

7. A connector as defined in claim 6, wherein said second leg portion terminates in a sharp edge (12) that digs into locking engagement with the electrical conductor, thereby to retain said conductor in said chamber in engagement with said bus bar.

8. A connector as defined in claim 7, wherein said release member is generally L-shaped and includes a pair of leg portions joined by an intermediate portion, and further including pivot means (23) pivotally connecting said intermediate portion with said housing, one of said release member leg portions (19) extending adjacent said second spring leg portion, and the other of said leg portions (20) carrying said pair of operating surfaces.

9. A connector as defined in claim 8, wherein said pivot means includes a pivot pin (23) on said release member having end portions that are supported in corresponding journal recesses (22) contained in said housing, respectively.

10. A connector as defined in claim 9, and further including stop means (25) limiting the extent of pivotal movement of said release member beyond said extended position.

11. A connector as defined in claim 10, wherein said stop means comprises pin means (25) mounted on said release member for engagement with a stop surface on said housing.

12. A connector as defined in claim 1, wherein said housing comprises a terminal block.

13. A connector as defined in claim 1, wherein said housing is retrofitted on an appliance having plug-in connections.

* * * * *